US005549405A

United States Patent [19]

Krahn

[11] Patent Number: 5,549,405

[45] Date of Patent: Aug. 27, 1996

[54] HEEL-SHAPED ERGONOMIC WRITING INSTRUMENT

[76] Inventor: Gilbert H. Krahn, 10100 - 38th St., Kenosha, Wis. 53144

[21] Appl. No.: 405,820

[22] Filed: Mar. 17, 1995

[51] Int. Cl.[6] ..... B43K 29/00; B43K 31/00

[52] U.S. Cl. ..... 401/195; 401/6; 401/52; 401/88

[58] Field of Search ..... 401/195, 52, 6, 401/88; 15/443

[56] References Cited

U.S. PATENT DOCUMENTS

| | | | |
|---|---|---|---|
| D. 329,458 | 9/1992 | Ellis | 401/6 X |
| 825,985 | 7/1906 | Schwertenberg | 401/6 |
| 2,459,993 | 1/1949 | Crain | 401/6 |
| 4,217,712 | 8/1980 | Koeln | 401/195 X |
| 4,302,121 | 11/1981 | Kim | 401/209 |
| 4,530,503 | 7/1985 | Rice | 401/195 X |
| 5,143,463 | 9/1992 | Pozil et al. | 401/6 |
| 5,143,465 | 9/1992 | Hou | 401/195 |
| 5,228,794 | 7/1993 | Hochstetler | 401/6 |

FOREIGN PATENT DOCUMENTS

| | | | |
|---|---|---|---|
| 1461643 | 12/1966 | France | 401/195 |
| 393980 | 4/1924 | Germany | 401/52 |
| 437049 | 5/1967 | Switzerland | 401/195 |
| 1582100 | 12/1980 | United Kingdom | 401/52 |

*Primary Examiner*—Steven A. Bratlie
*Attorney, Agent, or Firm*—Richard L. Miller, P.C.

[57] ABSTRACT

An ergonomic writing instrument comprising a writing instrument and a shell. The shell has a longitudinal axis and opposite ends and a hollow interior. The writing instrument is positioned within the shell with its operational end extending from one end of the shell. The portion of the shell furthest from the operational end is heel or "D" shaped, thus providing an ergonomically superior shape for a writing instrument. One can pick up this writing instrument and very easily grip the writing instrument correctly. Due to the comfortable conformity of the writing instrument to the natural arch between the thumb and the index finger, one can write for long periods without the fatigue or writing cramps which ordinarily accompany prolonged handwriting with conventionally shaped writing instruments.

8 Claims, 1 Drawing Sheet

FIG. 1
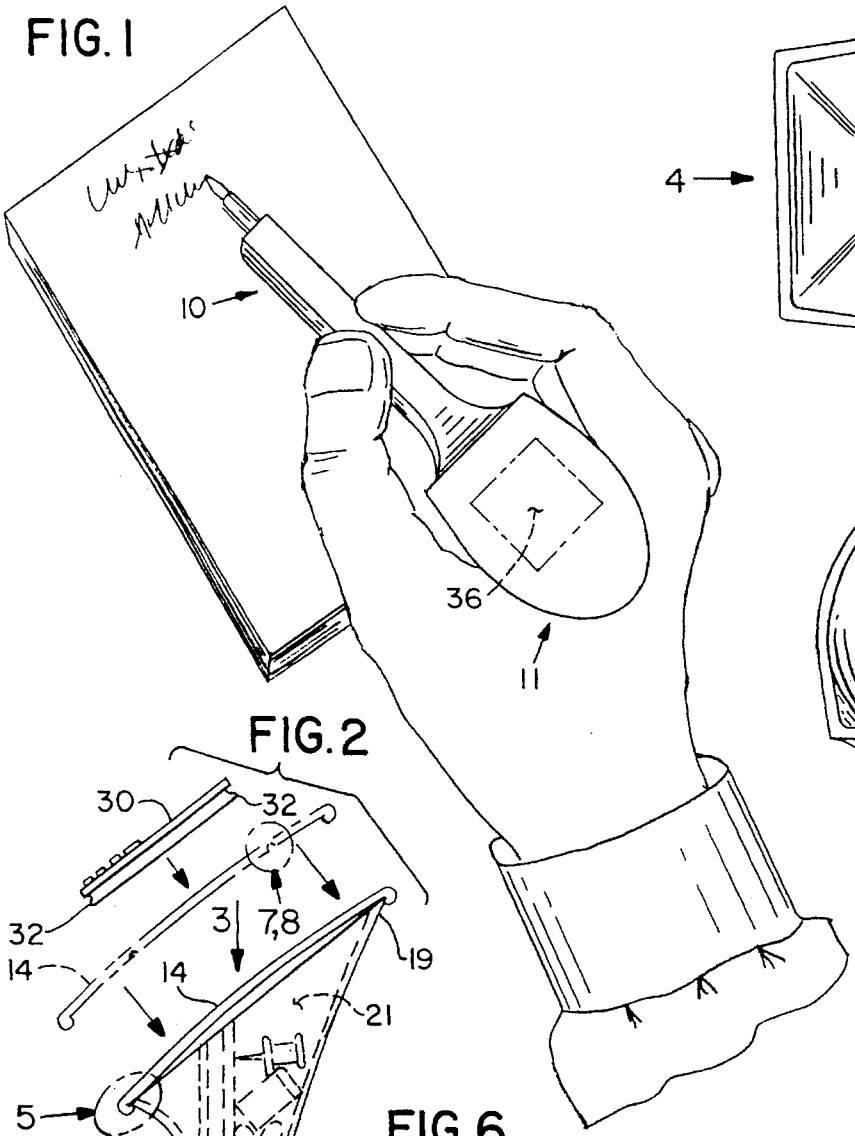
FIG. 3
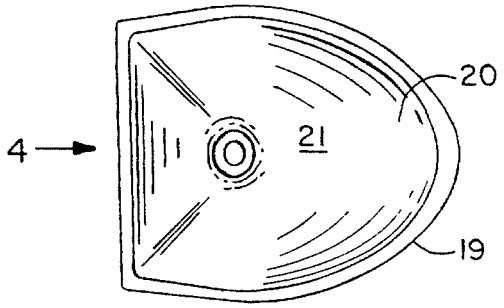
FIG. 4
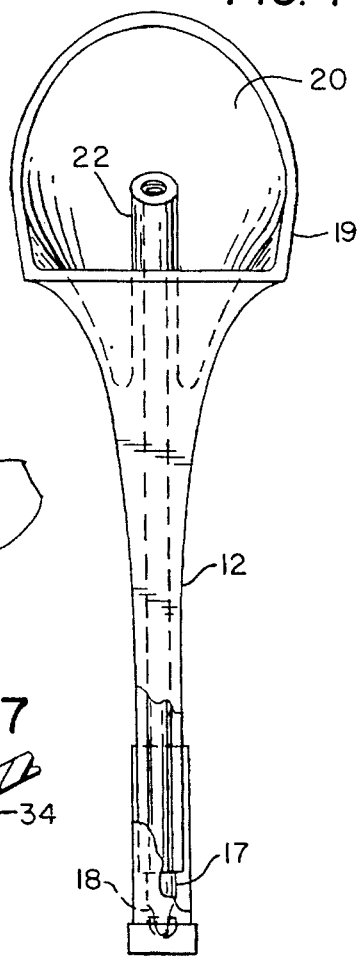
FIG. 2
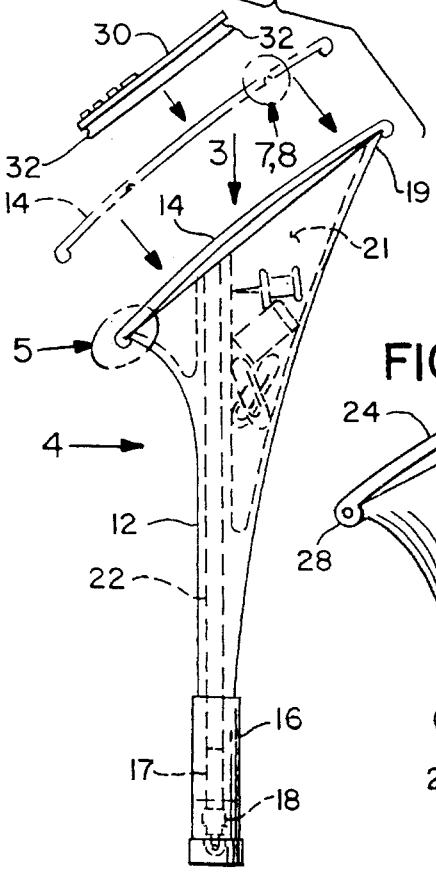
FIG. 6
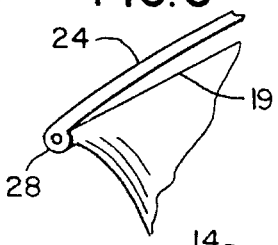
FIG. 7
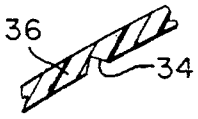
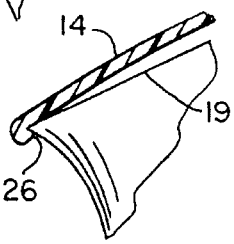
FIG. 5
FIG. 8
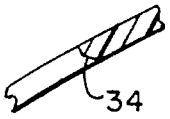
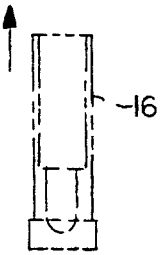

HEEL-SHAPED ERGONOMIC WRITING INSTRUMENT

BACKGROUND OF THE INVENTION

The instant invention relates to an ergonomic writing instrument, and more particularly to a pen or pencil which has an ergonomically superior shape and thus not only can it be better gripped to reduce writing fatigue and cramps, but also, due to its shape, it is less likely to roll off a writing surface.

DESCRIPTION OF RELATED ART

Many writing instruments are difficult to grip and uncomfortable in use. This is an especially serious problem for older people, children, and the handicapped who often have difficulty in gripping and using conventional writing instruments. Those who spend much time writing often experience writer's cramp and fatigue. It is therefore highly desirable to provide a new and improved ergonomic writing instrument.

An ergonomically shaped ball-point pen having three concave sides is described in U.S. Pat. No. 4,302,121 to Kim. The invention disclosed therein provides a ball-point pen with a barrel which has three concave surfaces extending along the length thereof. This shape facilitates holding the pen barrel by the thumb, index finger, and middle finger of the hand of the user.

A pear-shaped writing aid is described in U.S. Pat. No. 5,143,463 to Pozil et al. The invention disclosed therein provides a writing aid which comprises a small, generally pear-shaped body with a cylindrical hole running through the length thereof for insertion of a writing instrument. The smaller end of the writing aid is disposed near the writing tip of the instrument. The larger end of the writing aid is bulbous and supports the first knuckle of the thumb and index finger to hold the fingers in extended positions. This writing aid is preferably made of a soft, resilient material which provides a pliable surface and thus is relaxing to the fingers.

An ergonomic writing instrument having a shell with a spiral groove spiralling around the shell and running from one end of the instrument to the other is described in U.S. Pat. No. 5,228,794 to Hochstetler. The groove has a bottom and a side wall of such dimensions and shape that one can easily grip the writing instrument with a lighter than usual grip and yet press harder without the fatigue and writing cramps which usually follow long periods of time spent handwriting.

None of these inventions provides a shape with the characteristics required for a truly ergonomic writing instrument. It is highly desired that the shape of a writing 14 instrument conform to the natural arch between the thumb and the index finger which would greatly reduce fatigue while writing.

SUMMARY OF INVENTION, OBJECTS AND ADVANTAGES

Accordingly, the above mentioned problem is obviated by the present invention which provides a writing instrument with a shell whose shape conforms to the natural arch between the thumb and the index finger. Various size shells are provided for the full range of arch sizes possessed by users from child through adult.

It is therefore an object of the present invention to provide a writing instrument having an ergonomically superior shape which naturally fits the arch between the thumb and the index finger of the writing hand.

A second object of this invention is to provide a writing instrument which is less likely to roll off of a writing surface.

A third object of this invention is to provide a writing instrument which is less likely to be obscured by an object positioned on the writing surface.

A fourth object of this invention is to provide a writing instrument with a convenient storage space just underneath a removable cover at the end of the writing instrument.

Further scope of applicability of the present invention will become apparent from the detailed description given hereafter. However, it should be understood that the drawings and the detailed description, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a diagrammatic perspective view of the instant invention in use.

FIG. 2 is a side elevational view of the instant invention illustrating the interior in dots and showing some small items stored therewith, and with an optional calculator, watch, remote controller or other small solid state device which can be installed in the cover.

FIG. 3 is a top plan view taken in the direction of arrow 3 in FIG. 2 with the cover removed.

FIG. 4 is an enlarged front elevational view with parts broken away and taken in the direction of arrow 4 in FIGS. 2 and 3.

FIG. 5 is an enlarged fragmentary view of the area inside the dotted curve indicated by arrow 5 in FIG. 2, for a first embodiment of the instant invention, having a snap-on cover.

FIG. 6 is an enlarged fragmentary view of the area inside the dotted curve indicated by arrow 5 in FIG. 2, for a second embodiment of the instant invention, having a hinged cover.

FIG. 7 is an enlarged cross sectional view taken in the area of arrow 7 in FIG. 2 before the optional solid state panel has been removed from the cover.

FIG. 8 is an enlarged cross sectional view taken in the area of arrow 8 in FIG. 2 after the optional solid state panel has been removed from the cover.

DESCRIPTION OF PREFERRED EMBODIMENT

For illustrative purposes, the following drawings show a heel-shaped ergonomic non-retractable pen. It is well within the skill of the art to apply the same general principles to retractable ball-point pens, mechanical pencils, mechanical erasers, etc.

Referring to the various drawings, the heel-shaped ergonomic writing instrument is generally shown as numeral 10 in FIG. 1. Please notice how the heel-shaped part 11 of the shell 12 is comfortably cradled in the natural arch formed by the fingers and the thumb of the hand.

As shown in FIG. 2, the shell 12 of the writing instrument terminates at one end with an opening from which protrudes the refill 18 of a ball-point pen. This may be referred to as the instrument's operational end for writing. To protect the refill 18 from the elements and dust, the refill end of the pen is provided with a removable protection cap 16. Moving away from the refill end of the pen, the shell 12 flares outward and terminates in a heel shaped lip or rim 19 defining an opening 20 in the opposite end of the pen. The shape of the heel shaped portion of the shell can be varied within wide limits without departing from the spirit of the inventive concepts expressed herein. The heel consists of a straight portion and a curved portion. A closely related embodiment of this invention could have the heel comprising two curved portions thus presenting a somewhat oval appearance with essentially the same functionality as before. Or the straight portion could be very short as compared to the curved portion of the heel or D-shape.

The opening, 20 defined by the lip or rim 19 of the shell, provides access to a storage area 21 for such common desktop items as tacks, paper clips, and small erasers. The heel shaped lip or rim 19 is covered by a cover 14 which fits onto the lip or rim 19. In one embodiment of the instant invention, this cover may be secured to the heel-shaped lip 19 of the pen by bead 26 formed on the lower surface of the cover which causes the cover 14 to snap onto the heel shaped lip or rim 19 of the pen. The bead 26 is shown by the circled area of FIG. 2 pointed at by arrow 5, and can be more clearly seen in FIG. 5. In another embodiment of this invention as shown in FIG. 6, a hinged cover 24 is secured to the heel-shaped lip or rim 19 of the pen by a hinge 28. Here, the other end of the hinged cover 24 is secured to the heel-shaped lip or rim 19 by a bead on the lower side of the hinged cover 24.

The cross section of that portion of the shell 12 upon which the thumb and fingers of the writing hand rest can be heel or D-shaped, oval, square, or round, to accommodate various pen gripping preferences.

FIG. 2 shows an alternate optional solid state panel 30 that is installed in the D-shaped cover 14 of the pen and is held by protrusions 32 which cooperate with opening chamfer edges 34 provided when panel 36 is removed. This optional solid state panel can hold such devices as a calculator, watch, remote controller, or a tiny radio etcetera. In another embodiment of the instant invention, not shown, the cover of the pen may be imprinted with a logo, name, script, or art work such as to promote a company or product.

FIGS. 2 and 4 show the refill tube 22 which runs from the constricted refill end 17 of the shell 12 to the approximate center of the heel-shaped opening 20. The refill tube 22 is adapted to receive a ball-point pen refill. FIG. 4 shows the removable protection cap 16 removed and then installed on the writing tip 18 of the ergonomic pen.

Those who are skilled in the art will discern how the instant invention can be applied to such writing instruments as retractable ball point pens (both mechanical advance and clicker type), fountain pens, mechanical pencils, scribe, crayons, etc., and operating in a wide variety of mediums such as ink, graphite lead, etc. It is contemplated that the heel-shaped ergonomic writing instrument will be offered in a variety of colors, surface textures, print designs, coverings (leather, vinyl, etc.) and lengths for various size hands.

CONCLUSION, RAMIFICATIONS, AND SCOPE OF INVENTION

From the foregoing, it will be seen that I have provided an ergonomic writing instrument which is not only more comfortable to use than any of the background art writing instruments and aids but also which provides a storage compartment for small office essentials. Further the cover opposite the writing end of the writing instrument has broad functionality, providing a convenient surface for the installation of a wide variety of small solid state devices or a suitable area for insignia or inscriptions of various types. Further it will be appreciated that due to its shape, this writing instrument is much less likely to roll off of a writing surface and is less likely to remain hidden on a cluttered desktop than the background art writing devices.

Thus the reader will see that my invention supplies a long felt need for a comfortable, easy to use writing instrument having a variety of the most needed features and characteristics. Their are many variations of this ergonomic heel-shaped writing instrument which can be made without departing from the inventive concepts expressed herein. For example, the angle of the heel-shaped extremity with respect to the refill tube can be varied, and the shape of the heel can be varied from oval to elliptical to round without departing from the inventive concepts expressed herein. Accordingly, the scope of my invention should be determined not by the embodiments described, but by the appended claims and their legal equivalents.

What is claimed is:

1. An ergonomic writing instrument, comprising:

a) a hollow substantially elongated body having a longitudinal axis, an open substantially D-shaped bottom, an interior surface with an intermediate point, an open substantially D-shaped top having a perimeter and being disposed above, and larger than, said open substantially D-shaped bottom of said hollow substantially elongated body, said hollow substantially elongated body flaring smoothly upwardly and outwardly from said open substantially D-shaped bottom of said hollow substantially elongated body to said open substantially D-shaped top of said hollow substantially elongated body so as to form a substantially straight side and a substantially curved side therebetween, so that said substantially curved side of said hollow substantially elongated body can be comfortably cradled in a natural arch between a thumb and an index finger of a user in a relaxed position and said hollow substantially elongated body will not roll off of a writing surface and will not be obscured on a cluttered work surface;

b) a hollow cylindrically-shaped elongated tube disposed within said hollow substantially elongated body and extending along said longitudinal axis of said hollow substantially elongated body from said open substantially D-shaped bottom of said hollow substantially elongated body to said open substantially D-shaped top of said hollow substantially elongated body, said hollow cylindrically-shaped elongated tube contacting said interior surface of said hollow substantially elongated body from said intermediate point of said interior surface of said hollow substantially elongated body to said open substantially D-shaped bottom of said hollow substantially elongated body so as to form a conveniently accessible storage space between said intermediate point of said interior surface of said hollow substantially elongated body and said open substantially D-shaped top of said hollow substantially elongated body that is accessible from said open substantially D-shaped top of said hollow substantially elongated body, so that small common office items can be stored in said conveniently accessible storage space;

c) a substantially D-shaped cover having a perimeter and being movably mounted to, and closing, said open substantially D-shaped top of said hollow substantially elongated body, so that the small common office items stored in said conveniently accessible storage space are maintained therein, said substantially D-shaped cover having a substantially centrally-disposed removable portion with a lower surface perimeter, said lower surface perimeter of said substantially centrally-disposed removable portion of said substantially D-shaped cover being a V-shaped groove, so that said substantially centrally-disposed removable portion of said substantially D-shaped cover can be readily removed from said substantially D-shaped cover and when said substantially centrally-disposed removable portion of said substantially D-shaped cover is removed from said substantially D-shaped cover an opening with a chamfered perimeter is formed in said substantially D-shaped cover; and d) a solid state panel having a perimeter with outwardly extending protrusions cooperating with said chamfered perimeter of said opening of said substantially D-shaped cover when said substantially centrally-disposed removable portion of said substantially D-shaped cover is removed from said substantially D-shaped cover, so that said solid state panel can be conveniently installed in said substantially D-shaped cover.

2. The instrument as defined in claim 1, wherein said open substantially D-shaped top of said hollow substantially elongated body is oriented at a slant to said longitudinal axis of said hollow substantially elongated body.

3. The instrument as defined in claim 1, wherein said substantially D-shaped cover is snapingly mounted to said open substantially D-shaped top of said hollow substantially elongated body, said perimeter of said open substantially D-shaped top of said hollow substantially elongated body has an outwardly extending rim disposed therearound, said perimeter of said substantially D-shaped cover has a downwardly extending bead disposed therearound, so that said downwardly extending bead of said perimeter of said substantially D-shaped cover can snap onto said outwardly extending rim of said perimeter of said open substantially D-shaped top of said hollow substantially elongated body and maintains said substantially D-shaped cover in a closed position.

4. The instrument as defined in claim 1, wherein said substantially D-shaped cover is hingingly mounted to said open substantially D-shaped top of said hollow substantially elongated body by a hinge, said perimeter of said open substantially D-shaped top of said hollow substantially elongated body has an outwardly extending rim disposed therearound, a part of said perimeter of said substantially D-shaped cover has a downwardly extending bead that is disposed opposite to said hinge, so that said downwardly extending bead of said part of said perimeter of said substantially D-shaped cover can snap onto said outwardly extending rim of said perimeter of said open substantially D-shaped top of said hollow substantially elongated body and maintains said substantially D-shaped cover in a closed position.

5. The instrument as defined in claim 1, wherein said solid state panel is selected from the group consisting of a calculator, a watch, a remote controller, and a radio.

6. The instrument as defined in claim 1; further comprising a writing media disposed in said hollow cylindrically-shaped elongated tube and extending past said open substantially D-shaped bottom of said hollow substantially elongated body.

7. The instrument as defined in claim 1, wherein said writing media is selected from the group consisting of ball point pen refill, a length of lead, and a length of eraser.

8. The instrument as defined in claim 6; further comprising a removably mounted protective cap that is removable mounted to, and closes, said open substantially D-shaped bottom of said hollow substantially elongated body, so that said writing media is protected from elements and dust when said ergonomic writing instrument is not being used.

* * * * *